US009168627B2

(12) United States Patent
Elek et al.

(10) Patent No.: US 9,168,627 B2
(45) Date of Patent: Oct. 27, 2015

(54) KNIFE SHARPENER FOR ASIAN AND EUROPEAN/AMERICAN KNIVES

(75) Inventors: Bela Elek, Wilmington, DE (US); Daniel D. Friel, Sr., Greenville, DE (US)

(73) Assignee: Edgecraft Corporation, Avondale, PA (US)

( * ) Notice: Subject to any disclaimer, the term of this patent is extended or adjusted under 35 U.S.C. 154(b) by 799 days.

(21) Appl. No.: 13/045,846

(22) Filed: Mar. 11, 2011

(65) Prior Publication Data

US 2011/0244767 A1 Oct. 6, 2011

Related U.S. Application Data

(63) Continuation-in-part of application No. 12/401,034, filed on Mar. 10, 2009, and a continuation-in-part of application No. 12/845,961, filed on Jul. 29, 2010.

(60) Provisional application No. 61/313,237, filed on Mar. 12, 2010, provisional application No. 61/035,524, filed on Mar. 11, 2008, provisional application No. 61/232,065, filed on Aug. 7, 2009.

(51) Int. Cl.

| | |
|---|---|
| ***B24B 3/36*** | (2006.01) |
| ***B24B 3/54*** | (2006.01) |
| ***B24D 15/08*** | (2006.01) |
| ***B24B 3/58*** | (2006.01) |
| ***B24D 15/06*** | (2006.01) |

(52) U.S. Cl.

CPC . *B24B 3/543* (2013.01); *B24B 3/36* (2013.01); *B24B 3/54* (2013.01); *B24B 3/58* (2013.01); *B24D 15/06* (2013.01); *B24D 15/08* (2013.01)

(58) Field of Classification Search

CPC ..... B24B 3/36; B24B 3/54; B24B 3/543; B24B 3/58; B24B 3/586; B24B 7/17; B24D 15/06; B24D 15/08

USPC ..... 451/45, 192, 198, 261, 262, 263, 267

See application file for complete search history.

(56) References Cited

U.S. PATENT DOCUMENTS

| | | | |
|---|---|---|---|
| 1,342,275 | A | 6/1920 | Cornell |
| 1,360,998 | A | 12/1920 | Barber |
| 2,799,126 | A | 7/1957 | Dicke |
| 2,898,709 | A | 8/1959 | Bednarski |
| D202,799 | S | 11/1965 | Fano |
| 3,332,173 | A | 7/1967 | McMaster |
| 3,461,616 | A | 8/1969 | Nissen |
| 3,909,985 | A | 10/1975 | Knecht |
| 4,050,197 | A | 9/1977 | Thompson |
| 4,627,194 | A | 12/1986 | Friel |
| 4,716,689 | A | 1/1988 | Friel |

(Continued)

OTHER PUBLICATIONS

Declaration of Daniel D. Friel, Sr.

*Primary Examiner* — Eileen Morgan

(74) *Attorney, Agent, or Firm* — Drinker Biddle & Reath LLP

(57) ABSTRACT

A knife sharpener sharpens a wide range of knives and blades. The knife sharpener includes an angle guide associated with a first stage abrasive surface at an angle in the range of 12-18 degrees. A second stage is provided at an angle in the range of 17-23 degrees. A third stage is provided at an angle in the range of 19-25 degrees. The abrasive surface in the first and second stages is in the range of 240 to 400 grit while the abrasives in the third stage is in the range of 600 to 2000 grit.

24 Claims, 6 Drawing Sheets

(56) References Cited

U.S. PATENT DOCUMENTS

| | | | | |
|---|---|---|---|---|
| 4,723,375 | A | 2/1988 | Linden | |
| 4,807,399 | A | 2/1989 | Friel | |
| D303,209 | S | 9/1989 | Friel | |
| D310,620 | S | 9/1990 | Friel | |
| 5,005,319 | A | 4/1991 | Friel | |
| D328,410 | S | 8/1992 | Friel | |
| 5,148,634 | A | 9/1992 | Bigliano | |
| 5,245,791 | A | 9/1993 | Bigliano | |
| 5,611,726 | A | 3/1997 | Friel | |
| D409,891 | S | 5/1999 | Friel | |
| 6,012,971 | A | 1/2000 | Friel | |
| 6,113,476 | A | 9/2000 | Friel | |
| 6,267,652 | B1 * | 7/2001 | Friel et al. | 451/177 |
| 6,802,763 | B1 | 10/2004 | Leung | |
| 6,863,600 | B2 | 3/2005 | Friel | |
| 6,875,093 | B2 | 4/2005 | Friel | |
| 6,881,137 | B2 * | 4/2005 | Friel, Sr. | 451/349 |
| 6,997,795 | B2 * | 2/2006 | Friel, Sr. | 451/555 |
| D542,616 | S | 5/2007 | Elek | |
| D543,430 | S | 5/2007 | Barr | |
| 7,235,004 | B2 | 6/2007 | Friel | |
| D567,611 | S | 4/2008 | Elek | |
| D575,124 | S | 8/2008 | Smith | |
| D587,551 | S | 3/2009 | Friel | |
| 7,517,275 | B2 * | 4/2009 | Friel et al. | 451/198 |
| 2003/0236061 | A1 | 12/2003 | Li | |
| 2004/0077296 | A1 | 4/2004 | Friel | |
| 2004/0198198 | A1 * | 10/2004 | Friel et al. | 451/198 |
| 2007/0281590 | A1 * | 12/2007 | Friel et al. | 451/45 |
| 2009/0081931 | A1 * | 3/2009 | Levsen | 451/262 |
| 2009/0233530 | A1 | 9/2009 | Friel, Sr. | |

* cited by examiner

KNIFE SHARPENER FOR ASIAN AND EUROPEAN/AMERICAN KNIVES

CROSS-REFERENCE TO RELATED APPLICATIONS

This application is based on provisional application Ser. No. 61/313,237, filed Mar. 12, 2010. This application is a continuation-in-part of Ser. No. 12/401,034, filed Mar. 10, 2009 which, in turn, is based on provisional application Ser. No. 61/035,524, filed Mar. 11, 2008. This application is also a continuation-in-part of Ser. No. 12/845,961, filed Jul. 29, 2010 which, in turn, is based on provisional application Ser. No. 61/232,065, filed Aug. 7, 2009. All of the details of all of these applications are incorporated herein by reference thereto.

BACKGROUND OF THE INVENTION

For generations, knife sharpeners have been available to sharpen dull knives but without regard to the angle of the knife edge. Knives produced in factories were made largely by artisans who undertook to create a sharp edge without regard to the angle of the edge. Sharpness was the focus and it did not matter to the artisan what the angle was. That was true also after the factory knife was sold, used, and became dull. The owner sought to sharpen the edge somehow, with a tool file, on a sharpening stone, or perhaps with a sharpening "steel". The angle at which the edge facets were formed by the user was not recognized as important. Factory edge angles were not standardized by any of the large or small knife factories. They did not consider it of any importance, particularly since the user had no sense of the importance of the edge angle and had no means or ability to sharpen the edge at a specified or controlled angle. As a consequence, for generations knife sharpeners have been sold without specifying anything more than "the sharpener will create a sharp edge on your knife". In general both factory knives and sharpeners have been sold only on the expectation that the resulting knife will be sharp.

The consumer has had no expectations or concerns about the actual angle of the edge—only that it be sharp enough for the job at hand. Examination of the knives produced in Europe shows that the total edge angle varied from about 40 degrees to 60 degrees or larger. American manufacturers have followed the European practices. Asian knives made with smaller edge angles have not been readily available or popular in the United States, but that has begun to change recently.

The European designs of knife edges with their relatively large angles have evolved as a result of their diets and methods of food preparation. In general the European style knife is designed for butchering and to cut tough fibrous foods such as a wide variety of meats.

Knives manufactured in Japan and Asia are found to have edge angles of about 10 degrees to 20 degrees, most commonly about 15 degrees which they have found to be practical for cutting fish and other softer, less tough foods than those encountered in Europe.

The recent interest of the Asian style cutlery has presented new challenges for American knife sharpeners that historically have been designed exclusively for the larger angled European and American, style knives. The Asian knife customer commonly has not been willing to trust his knife to existing European or American sharpeners and he has continued largely to sharpen his Asian knives tediously by hand on sharpening stones.

As a consequence of the confusion created by the introduction of Asian style knives into America, several sharpeners have been offered to handle both Asian and European style knives.

These sharpeners are simply a physical combination of two sharpeners, one for the larger angle European knives and one for Asian style knives incorporated into a single housing. These commonly have one sharpening stage or section dedicated to European blades and another dedicated separate sharpening stage or section to sharpen Asian blades. Such sharpeners are consequently large, very expensive, and produce relatively weak knife edges particularly for the thinner low edge angle Asian blades.

A primary reason why Asian knives have not been popular in America is that American foods are generally more like the Europeans—tougher and more fibrous. It has been shown that lower angle Asian knives as sold commercially do not hold up as well when cutting tougher American foods. The thin 15 degree edge bends over in use and quickly becomes dull.

The attraction of the Asian edge to the American consumer is that it appears to be sharper than when cutting with the European knives. This is because the edge facets are set at a total included angle of only on average 30 degrees or so which will cut easier and in fact feel like a sharper wedge than the 40 degree wedge of the European edge.

Forty degree total angle edges are however stronger, do not fold over so fast and hold up longer when cutting the tougher American type foods. A recognition of the inherent weakness of the thirty degree edge has been a deterrent to wide acceptance of the Asian edges—in spite of the perception they cut with less effort.

These inventors have discovered unique simpler, more compact, less expensive designs for sharpeners that can handle both European and Asian style knives. In spite of their simplicity these new sharpeners create sharper and longer lasting edges for both classes of knives than, for example, any other commercially available manual sharpeners offered to sharpen both classes of knives. Further the new design disclosed here produces precision edges of a quality equal to new factory produced knives.

SUMMARY OF THE INVENTION

Application Ser. No. 12/401,034 discloses techniques for providing a single sharpener to effectively sharpen both Asian/Japanese and Euro-American knives. In particular these techniques are shown as being incorporated in electric knife sharpeners. The present application discloses how such techniques can also be incorporated in manual knife sharpeners.

One or more manual knife sharpeners have been introduced in America during the last two years in response to new interest in Asian style knives. These introductions are merely physical combinations of two distinctly different and separate sharpeners, one for European style blades and one for Asian style knives in a single housing. This invention relates to a novel yet simple design manual knife sharpener that can put a superior edge on both European and Asian knives that is less expensive, of smaller size, creates better and sharper edges than those on most factory-made new knives and leaves an edge on Asian knives that is more durable than those on conventional manual sharpeners. Surprisingly this novel design results in 15 degree edges that are in general as durable as the conventional larger 20 degree edge, but retains the extra apparent sharpness of a conventional 15 degree edge.

This novel sharpener is described in the following disclosure

THE DRAWINGS

DETAILED DESCRIPTION

Figure 1:
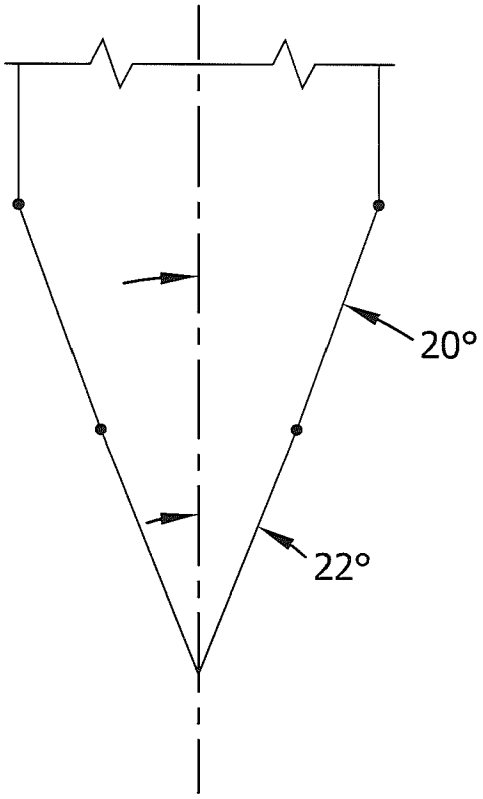
FIG. 1 is a front elevational view of conventional 20° edge facets with a large second burr.
Figure 2:
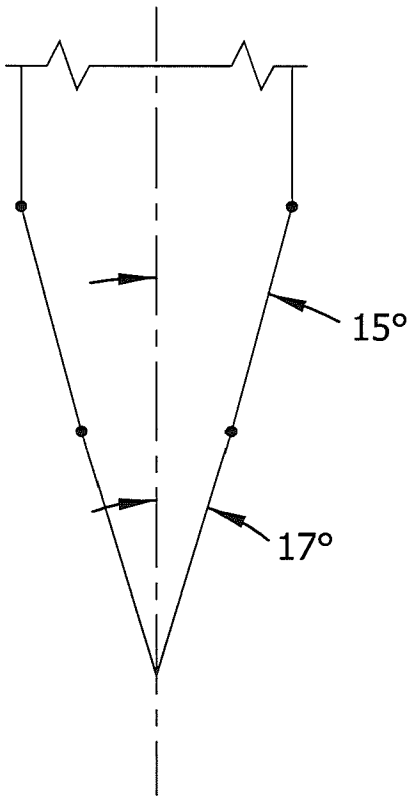
FIG. 2 is a front elevational view of conventional 15° edge facets with a large second bevel.

This invention relates to a high quality versatile and unique manual sharpener with only 3 sharpening stages that can sharpen with high precision in two sharpening steps either 15 degrees Asian knives or the conventional 20° European/American style. Prior to this development the creation of an edge on a conventional 20° edged knife in the most advanced sharpeners has been obtained by a two stage process where the first stage has an aggressive sharpening abrasive to grind a full primary 20° facet along each side of the edge. State of the art sharpeners then polish the entire or majority of the primary facet length with a finer abrasive set at the same angle or at a slightly larger angle, about 22° (FIG. 1). Similarly to sharpen an Asian 15° edge (30° total) the first stage would be set at 15° and the second stage would be in the range of 15-17 degrees, the two stages being just about 2 degrees difference in order to refine virtually the entire facet surfaces and to create a second bevel along a majority of the facet length as shown in FIG. 2. It has been common practice in modern two step sharpeners to create generous facets in each step and to keep the sharpening angles in these steps very close so that the second refining bevel does not alter significantly the effective angle of the blade edge.

It is easy to visualize how 4 stage sharpeners with stage 1 set at 15°, stage 2 set at 17°, and with stages 3 and 4 set at angles of 20 and 22 degrees were commercialized to sharpen either or both style knives with primary angles of 15° or 20°. The two stages of 15 and 17 degrees are used exclusively for 15 degree Asian knives and the last two stages of 20 and 22 degrees are used exclusively to sharpen the Euro/American 20° style blades. The choice of these angles insured that the resulting edge of the sharpened conventional 20 degree edge would be not over 22 degrees and the 15° edge would be not larger than 17°. What we have shown however is that a three stage sharpener with sharpening angles of about 15°, about 20°, and about 22° respectively can be used to create edges or better of equal sharpness and cutting ability than a four stage design. In order to realize the improved edge however with fewer sharpening stages requires a non-intuitive change in the sharpener design and sharpening procedure.

To accomplish this the Asian style knives are sharpened first in just one dedicated stage—to create a full primary facet set around 15°, while European American knives are also sharpened first in a simple but different dedicated stage set around 20° and subsequently both types of edges are refined by creating a tiny microscopic bevel in the third stage set at about 22 degrees. These tiny bevels are sufficient in size to refine the edge removing major edge imperfections, improving the geometric perfection of the edge and increasing the edge strength but not so large in size that the superior effective sharpness of the 15° edge is adversely affected. Although the primary 15 degree facets have a tiny 22° facet at the very edge the knife still cuts with the ease of a 15° knife—because the 22° facet is very small. The 15° wedge action is not significantly disturbed.

Figure 3:
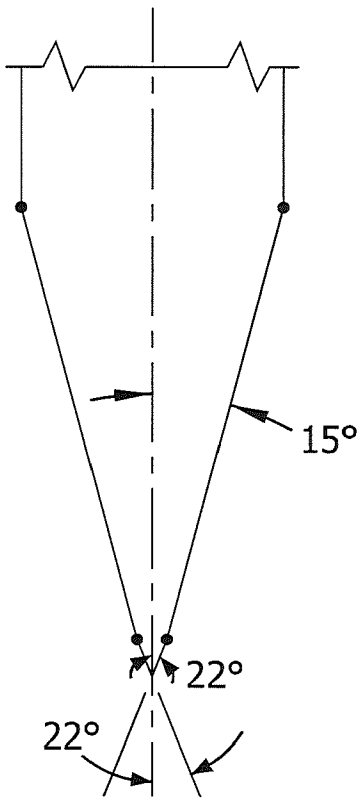
FIG. 3 is a front elevational view of primary 15° edge facets with a micro second bevel.

The surprising discovery is that the Asian blade can be sharpened well by using Stages 1 and 3 that are separated by an unconventional large difference on the order of 7 degrees if the second bevel is kept physically very small. However, in order to achieve an optimum edge with this three stage design the length of the second bevel created at about 22° on the Asian knives in Stage 3 must purposely be microscopically small and created only at the very tip of the first stage 15° bevel. By that technique the profile of the Asian edge facet remains basically a 15° edge with a very tiny bevel of 22° at the very tip of the primary 15° bevel as shown in FIG. 3. The length of the 22° bevel must be extremely small and created with a fine grain abrasive. This gives the nominal 15° edge essentially the strength of a conventional 22° edge that has been highly polished. This necessitates that an extremely fine abrasive be used in Stage 3. A micro-sized diamond abrasive is used in stage 3 to create the exceedingly well formed but microscopic sized facet. The ultra fine abrasive insures that only an extremely small facet is formed even if the user makes an excessive number of passes of the blade thru that Stage.

In this description the angle of stage 1 is referred to as angle A. The angle of Stage 2 is referred to as angle B. The angle of stage 3 is referred to as angle C. Angle C is at least five degrees greater than angle A.

In order to optimize performance of this improved three stage procedure requires careful selection of the abrasive material and the abrasive grit size. In all stages it is advantageous to use diamond abrasives that because of their hardness will hold their shape well and create the small facets accurately at the correct angle and size. The grit in Stages 1 and 2 can best be in the range of 240 to 400 grit to sharpen sufficiently fast, while the abrasive in Stage 3 should best be in the range of 600 to 2000 grit to insure the best highly polished edge. The particle size of a 2000 grit abrasive is only about 12 microns which is about ¼ the thickness of a human hair.

As mentioned earlier, the Asian blades with edge facets formed at 15° seem sharper, that is they cut with less effort because like a wood splitting wedge, a lower-angle wedge splits the wood easier. However experience shows that the 15° splitting wedge becomes dull faster than a 20° splitting wedge. The same relationship holds true with 15 and 20 degree edge knives. The surprising thing is that a very small, virtually microscopic larger angle bevel can be placed along the 15° edge to lengthen the life of the edge, to resist dulling significantly while retaining the lower cutting effort characteristics of the lower angle 15° blades. Durability of the 15° blade is increased close to that of a 22° edge without loss of sharpness of the edge when cutting foods in the kitchen. This discovery makes it possible to offer a sharpener with only 3 stages that can do both 20° and 15 (half angle) knife edges and yet improve significantly the durability of the thin 15° edge. In this 3 stage sharpener it is clear why the third stage set at about 22° must not be aggressive and therefore must use a very fine abrasive disk preferably with a low force being applied between the abrasive and the knife edge.

In use the operator of this new sharpener will use Stage 1 only for Asian knives to place a primary facet along their edge. While factory made Asian knives are referred to here and elsewhere as 15 degree knives, the angle of their primary cutting edge facets does indeed vary widely as sold by their manufacturers, over a range of 14 to 18 degrees commonly and occasionally with outliers as small as 10° or as large as 20°. The outliers can be considered either as factory mistakes or intentional but these can be found with "Asian" labels. In this application any knife with cutting edge angles less than 18° is considered Asian and in an attempt to design for and discuss this wide range we will refer to these generally as 15 degree knives. The single facet sharpening stage designed and dedicated here for this wide range of Asian knives is perhaps best set somewhere between 12-18 degrees, preferably 15 degrees, in order to closely approximate the best factory angles that are considered to be best for Asian type foods.

Knives classified as European/American likewise have edge angles that vary widely between manufacturers and styles but their edge facets are commonly anywhere from 17 to 23 degrees with outliers well beyond that range. We concluded for the design of this new sharpener that the European/American knives that the existing knives are best considered to be between 17-23 degrees as they are made for the factory. While knives with edge angles of about 17-18 degrees can be found with either label on them, knives in that range are unlikely to be considered satisfactory by the knowledgeable buyers who want a knife edge that will be better suited to cut their particular softer more delicate Asian food or their Western tougher more fibrous foods. Our unique sharpener is designed to provide either class of customer with the near ideal knife edge angle for their particular food.

In order to implement this novel design principle any of a variety of knife guiding means or abrasive configurations can be employed. For example, the guiding means can be a single slot in each stage that directs the knife edge simultaneously against one or more abrasive elements located on each side of the edge in order to sharpen both edge facets of a given knife at once. Alternatively each stage can consist of two knife guiding slots, the first of which locates and directs one side of the knife edge, that is one facet against one or more abrasive sharpening element in order to sharpen that first facet and then the knife is placed in the second knife guiding slot of that stage to locate and direct the opposite edge facet against one or more sharpening elements at the correct angle in order to sharpen the opposite facet running along the knife edge.

In general what we will now describe is an example of a special sharpener incorporating the essence of this new sharpening approach. It utilizes special sharpening elements for sharpening knives that have a double facet along the cutting edge, comprising three sharpening elements each made of a pair of disks mounted on a rotatable shaft supported by molded-in bearings that are part of the molded sharpener structure. The sharpening disks are faced with an abrasive coated member that has the surface contour of a truncated cone. The disks are pressed fitted onto the rotatable shaft with the small ends of the truncated cones pressed into contact with each other on the shaft. The abrasive coated members are metal stampings pressed with the truncated cone geometry. The body of the disks can be a plastic structure that supports the metal stampings and where the disk structure has a hub-like configuration that fits snugly on the rotatable shaft.

The physical design of this exemplatory sharpener that incorporates the basic elements of this new approach to sharpening both of the popular 15 and 20 degree knives using this new and novel 3 stage approach can take many forms. A preferred design is described here in detail. Other variations using this principle will be obvious to those skilled in this area.

Figure 4:
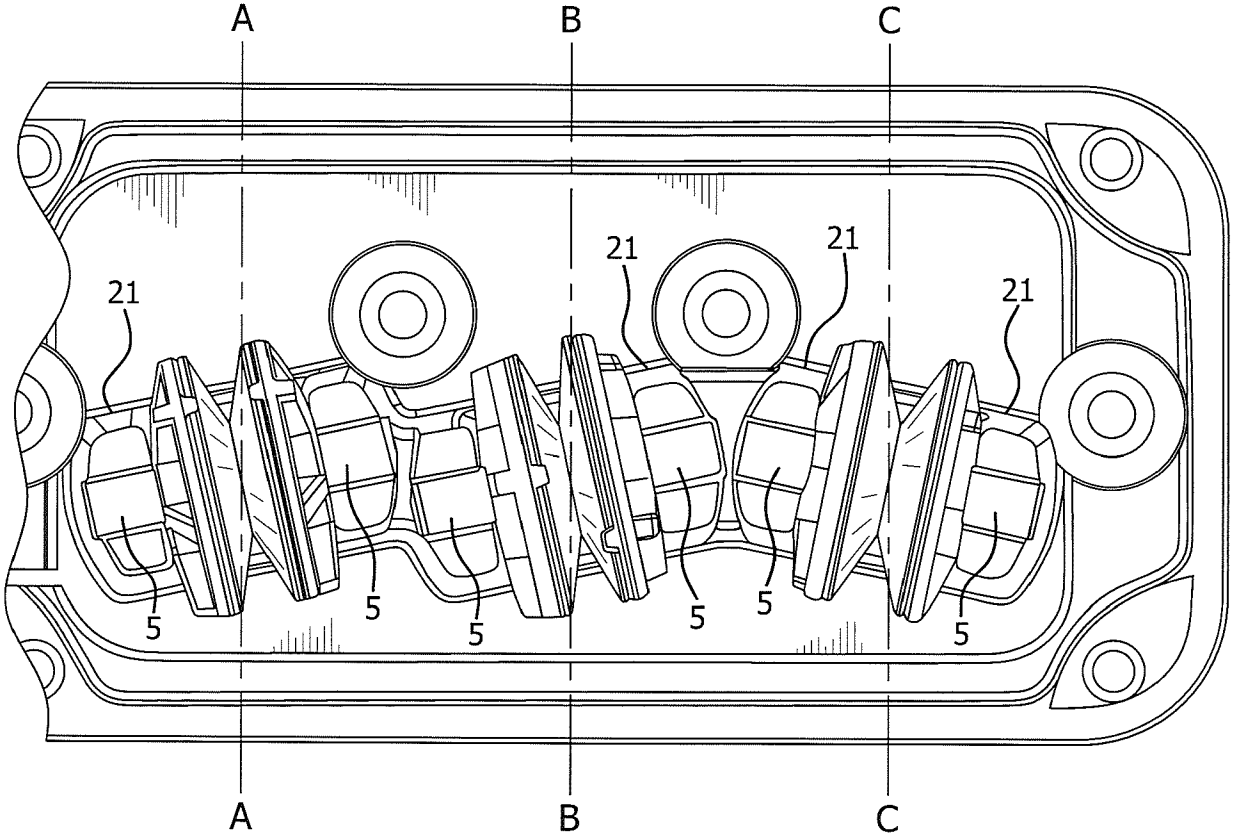
FIG. 4 is a top plan view of manual sharpening elements according to a 3 stage sharpener of this invention.
Figure 5:
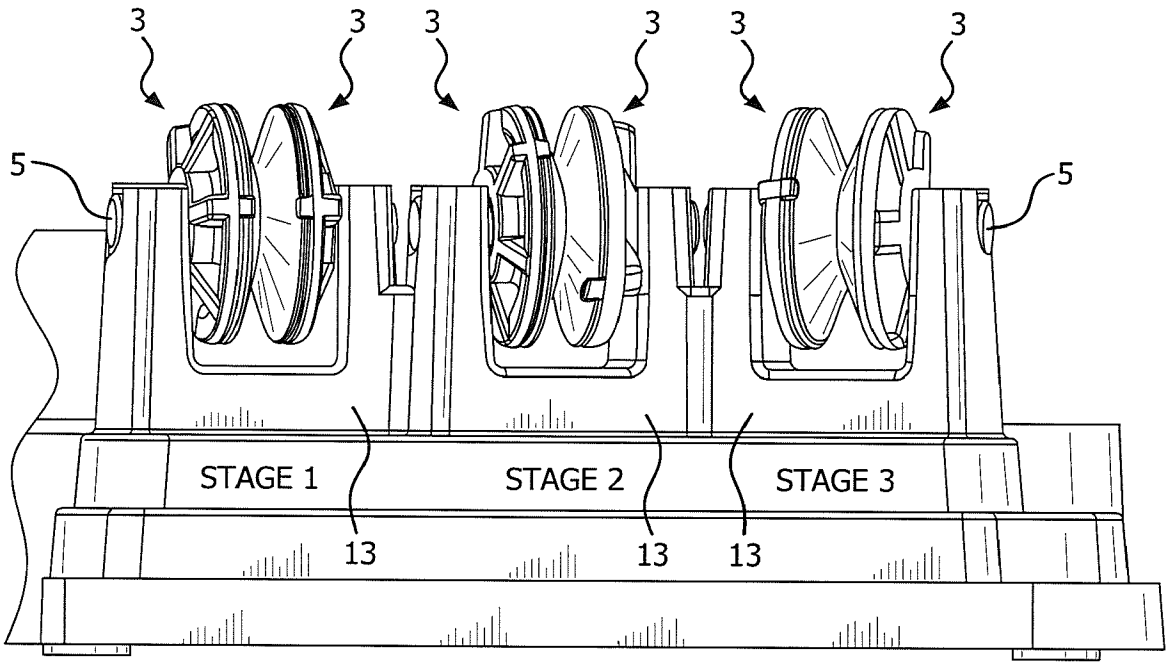
FIG. 5 is a front elevational view of the sharpener shown in FIG. 4.
Figure 6:
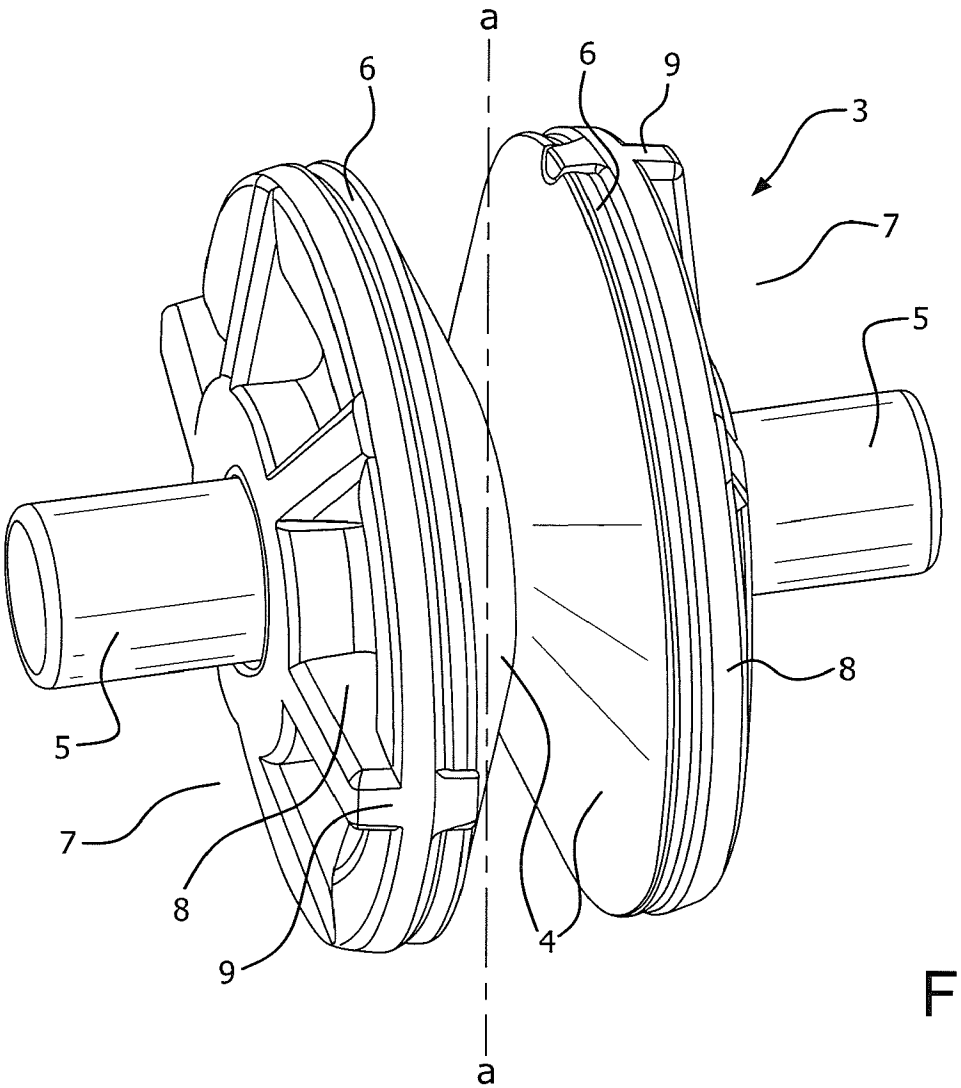
FIG. 6 is a detail assembly drawing of a sharpening element in the sharpener of FIGS. 4-5.

FIGS. 4 and 5 further illustrate this preferred arrangement and design of multiple sharpening elements used in this new knife sharpener. These sharpening elements are of the type disclosed in parent application Ser. No. 12/845,961. FIG. 5 is an elevation of the arrangement and the plan view is seen in FIG. 4. The basic overall sharpening element 3 incorporated in FIGS. 4 and 5 is shown in FIG. 6. Each sharpening element 3 comprises of two individual sharpening disks 7 which have diamond abrasive coated surfaces 4 juxtaposed and pairs of these disks 7 are pressed onto a precision steel shaft 5 to form sharpening element 3. The facing individual diamond coated surfaces 4 have the nominally shape of precision truncated cones. The two disks 7 are press-fitted onto the ground steel shaft 5 in intimate physical contact at their smaller cylindrical surfaces. The facing diamond abrasive coated surfaces 4 of the disks 7 are formed on the surfaces of thin metal stampings 6 formed with a truncated cone shaped contour. The stampings are mounted in turn on precision plastic molded supporting hub 8 that have an exterior contoured surface that mates with the interior shape of the metal abrasive coated stampings 6. The shafts 5 of each sharpening element are supported in bearings 21 and are free to rotate as the knife is drawn back and forth to sharpen the edge. The bearings 21 are part of the molded supporting structure 13 of the sharpener, FIGS. 4 and 5.

The molded supporting hubs 8 of the disks are molded with a precision interior diameter cylindrical hole to be a press fit to the diameter of the shaft 5 that can have a slight knurling to make a better fit to shaft 5. The path of the knife edge when sharpening follows broken line a-a (FIG. 6) as the knife is pulled across the element 3 so that one facet of the knife is abraded on the left disk 7 and the right facet is abraded on the right disk 7. The knife edge passes through at a non-perpendicular angle to shaft 5. Such angle is preferably in the range of 10-15 degrees off axis.

The plastic molded hubs 8 of the sharpening disks have around their perimeter one or more indexing tabs 9 to insure that each of the metal stampings, which has corresponding slots on their diameter will fit snugly into the tabs 9 in order to prevent rotation of the abrasive coated stampings on their supporting molded hubs 8. Alternatively or in addition the stampings can be held onto the molded support 7 with an adhesive. The angle of the surfaces of the abrasive coated truncated cone shaped surfaces are customized in each stage to sharpen the knife facets at precisely the appropriate angle for each stage.

FIGS. 4 and 5 show for example, how the special sharpening elements 3 are arranged to implement this new sharpener and sharpening concept. The orientation and alignment of the blade edge is shown as a broken line in Stages 1, 2 and 3 and are marked A-A, B-B, and C-C, respectively. Asian 15 degree knives would be sharpened in Stage 1 and Stage 3 while Euro/American 20 degree knives would be sharpened in only Stages 2 and 3. The truncated abrasive surfaced disks of Stage one (1) would be precisely shaped and coated with an appropriate abrasive sized to create quickly a full primary facet commonly in the range of 12 to 18 degrees, and preferably 15 degrees, to optimize the edge angle for Asian blades. The truncated abrasive surfaced disks of Stage two (2) would be shaped and coated with an abrasive sized to quickly place a full primary facet on European/American style blades optimally within the range of 17 to 23 degrees, and preferably 20 degrees, to optimize the edge angle for these quite different blades to be used by the consumer for a different task than the Asian blades. The abrasive surfaced disks of Stage three (3) would be shaped and coated with an ultrafine abrasive to create the ultra small secondary facet (bevel) along each side of the edge, regardless of whether it be an Asian or European/American blade edge. That small facet would be placed at an angle close to, but larger than the angle of Stage 2, by perhaps 2 to 4 degrees. Preferably the angle in Stage 3 would be 22 degrees.

Figure 7:
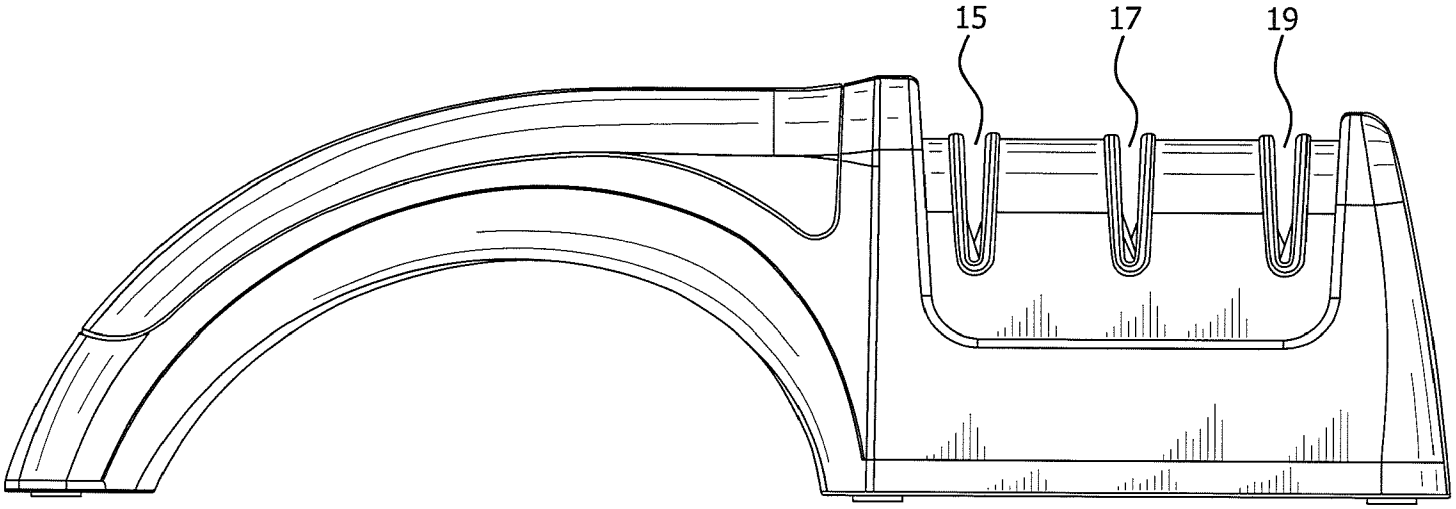
FIG. 7 is a front elevation view of an example stage sharpener in accordance with FIGS. 4-6.
Figure 8:
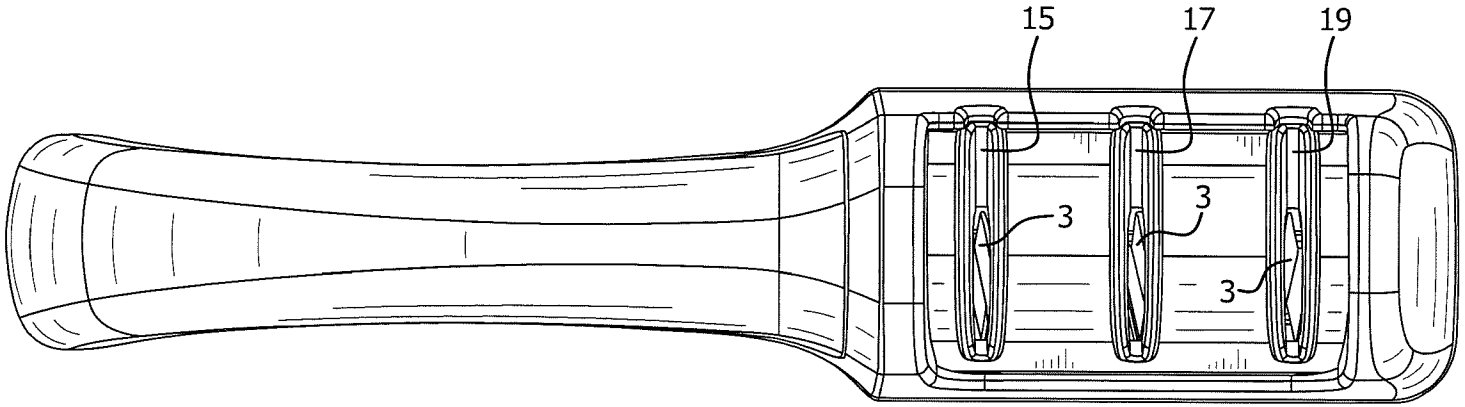
FIG. 8 is a top view of the sharpener of FIG. 7.

FIGS. 7 and 8 show the exterior design and appearance of one sharpener that employs the arrangement of sharpening elements as shown in FIGS. 4 and 5. The sharpening Stages 1, 2 and 3 employ vertical slots 15, 17 and 19 respectively in FIGS. 7 and 8 to guide the knife blades as they are pulled manually across the sharpening elements that are shown in FIGS. 4 and 5. In this arrangement and design both facets of the knife edge structure are sharpened simultaneously. Alternative manual designs of the sharpening elements such as abrasive pads, interdigitating pads of U.S. Pat. No. 5,390,431 or multiple crossed abrasive, skiving, or steeling elements can be used to sharpen or condition the knife edges in 3 stage manual sharpening arrangements using the novel 3 stage procedure disclosed here to professionally sharpen both Asian and European/American knives in the same sharpener and realize factory quality edges. Other designs that incorporate different knife guiding means to individually and sequentially sharpen the right and left facets, one at a time, can be considered for knives that have single sided edges, such as the traditional Asian knife out of Japan. See U.S. Pat. No. 5,404,679 for example. The details of these patents are incorporated herein by reference thereto.

To sharpen a knife in this novel combination of three (3) stages the user must, if he has an Asian knife, sharpen the Asian knife first in Stage 1 to develop a full 15 degree edge facet along each side of the edge. The abrasive in Stage 1 is sufficiently aggressive to sharpen the facets fairly quickly leaving a primary facet of 15°. The user of this type knife must not sharpen in Stage 2 if he wishes to maintain the cutting properties of his normal 15° edge. Instead he moves the knife to Stage 3 where he micro-hones the edge gently with a very fine micron sized abrasive, preferably diamond, set at for example at 22 degrees. The very fine particle sized abrasive insures creation of a microscopically small facet, but a well formed facet along the tip of the large primary edge facet. The facet is small enough that it does not significantly alter the geometry of original primary 15° facet along the edge—thus insuring the nominal 15° wedge acting shape of the edge is left in tact. This small micro-facet at 22° is sufficient to strengthen the 15° (half angle) edge and increase its durability to that comparable to a 20° edge. The larger angle at the very edge makes it more difficult for the cutting action to bend over the edge structure, which is the most common mode of edge failure.

As disclosed in application Ser. No. 12/401,034, the secondary bevels formed by the third stage may be formed only in the lower 20-30% of the facet length adjacent the edge of the primary facet. In addition, the third stage disk may be a rigid disk.

The physical arrangements of the sharpening abrasive plates and the knife guiding means to establish the sharpening angles can, for example be similar to those described in U.S. Pat. No. 5,390,431 and U.S. Pat. No. 5,582,535, but other configurations are wholly practical. Other configurations are possible. All of the details of U.S. Pat. Nos. 5,390,431 and 5,582,535 are incorporated herein by reference thereto.

FIGS. 4-10 illustrate a manual knife sharpener in accordance with this invention. As noted, the knife sharpener incorporates many of the principles of the electric knife sharpener described in co-pending application Ser. No. 12/401,034, all of the details of which are incorporated herein by reference thereto. The knife sharpener also utilizes sharpening elements of the type described in co-pending application Ser. No. 12/845,961, all of the details of which are incorporated herein by reference thereto. As illustrated the manual sharpener includes three stages designated by the numbers 1, 2 and 3 in FIGS. 4-6. In each of these stages the appropriate sharpening elements and guide surfaces would be provided to sharpen the knife blade in the previously described manner.

What is claimed:

1. A precision manual knife sharpener for selectively sharpening with the same sharpener knives and blades representative of two widely different style of knives having different factory made primary edge facets established at widely different primary angle A and primary angle B, said sharpener comprising a first stage having a first stage disk with an abrasive surface for sharpening a first primary angle facet blade edge of a first knife, a first knife angle guide in said first stage to position the blade edge facet of the first knife into contact with said first stage abrasive surface to establish the first primary angle facet along the blade edge, said first stage guide located with respect to the first abrasive surface at an angle A which is in a range no greater than 18 degrees, said first stage abrasive surface having its abrasive surface from abrasives in the range of 240 to 400 grit, a second stage having a second stage disk with an abrasive surface for sharpening a second primary angle facet blade edge of a second knife, a second knife angle guide in said second stage to position the edge facet of the second knife into contact with said second stage abrasive surface to establish the second primary angle facet along the blade edge, said second stage guide located with respect to the second stage abrasive surface at an angle B which is greater than angle A, a third stage having a third stage disk with an abrasive surface for selectively sharpening the blade edge of the respective first knife and second knife to create a microscopic bevel at the tip of the blade edge of the respective first knife and second knife, a third knife angle guide in said third stage to position the blade edge facet into contact with said third stage abrasive surface, said third stage guide located with respect to the third stage abrasive surface at an angle C which is at least as great as the angle B of the second stage and which is at least 5 degrees greater than angle A of the first stage, and said third stage disk having its abrasive surface formed from ultra fine abrasives.

2. The sharpener of claim 1, wherein said angle A is about 15 degrees, said angle B being about 20 degrees, and said angle C being about 22 degrees.

3. The sharpener of claim 1, wherein the abrasives of all said stages are 100% diamonds.

4. The sharpener of claim 1, wherein the abrasives of all said stages contain diamonds.

5. The sharpener of claim 1, wherein said abrasive surface in each of said first stage and said second stage and said third stage is part of a sharpening element in each of said stages, said sharpening element comprising a pair of disks mounted on a rotatable shaft supported by appropriate bearings, and said disks faced with an abrasive coated member contoured nominally on its outer coated surface as a truncated cone press-fitted onto said shaft with the smaller end of each disk's coated surface in nominal physical contact so that the knife passes through at a non-perpendicular angle to said shaft.

6. The sharpener of claim 5 for sharpening knives where the abrasive coated members are metal stampings with an abrasive coating on the outer surface of their contour.

7. The sharpener of claim 6 for sharpening knives where the disks are supported onto the rotating shaft by means of a plastic hub that is an integral part of said disks and said shaft is knurled to secure the disks onto said shaft.

8. The sharpening element of claim 5 for sharpening knives where said angle is from 10 to 15 degrees off axis.

9. The sharpener of claim 1, wherein said third stage disk is a rigid disk.

10. The sharpener of claim 1, wherein angle B is in the range of 17-23 degrees, angle C being in the range of 19-25 degrees but being greater than angle B and being at least 5 degrees greater than angle A, angle A being in the range of 12-18 degrees, said second stage disk having its abrasive surface formed from abrasives in the range of 240 to 400 grit, and said third stage disk having its abrasive surface formed from ultra-fine abrasives in the range of 600 to 2000 grit.

11. The sharpener of claim 1 wherein angle A is about 15 degrees.

12. The sharpener of claim 1 wherein angle C is 7 degrees greater than angle A.

13. The sharpener of claim 1 wherein said third stage disk is press-fit on a rotatable shaft.

14. A method of selectively sharpening first and second knives with the same sharpener wherein the first knife has a different primary angle facet than the primary angle facet of the second knife, comprising providing the sharpener of claim 1; for sharpening the first knife, sharpening the first knife in the first stage to create a primary angle facet at angle A, then sharpening the first knife directly in the third stage without sharpening in the second stage to create a microscopic bevel at the tip of the primary angle facet at angle C; for sharpening the second knife, sharpening the second knife first in the second stage to create a primary bevel at angle B without sharpening in the first stage, and then sharpening the second knife directly in the third stage to create a microscopic bevel at the tip of the primary angle facet at angle C.

15. The method of claim 14 wherein the first knife is an Asian/Japanese style knife and the angle A is about 15 degrees, the second knife is a Euro/American style knife and the angle B being about 20 degrees, and the angle C being about 22 degrees.

16. The method of claim 14, including forming the microscopic bevel only in the lower 20-30% of the facet length adjacent the primary angle facet.

17. The method of claim 14 wherein angle B of the sharpener is in the range of 17-23 degrees and angle C is in the range of 19-25 degrees but the angles selected for angles A and B and C are such that angle C is greater than angle B and angle C is at least 5 degrees greater than angle A, the second stage disk grit size being in the range of 240-400 grit and the third stage disk grit size in the range of 600 to 2000 grit, selecting as the first knife an Asian/Japanese style knife having a primary angle facet at the angle of angle A, and selecting as the second knife a Euro/American style knife having a primary angle facet at the angle of angle B.

18. The method of claim 14 wherein the first knife is an Asian/Japanese style knife having a primary angle facet of about 15 degrees, and angle A is about 15 degrees.

19. The method of claim 14 wherein angle C is 7 degrees greater than angle A.

20. The method of claim 14 wherein the third stage disk is press-fit on a rotatable shaft, and rotating the shaft as the respective knife is drawn back and forth.

21. A sharpening element for sharpening knives that have a double faceted cutting edge comprising a pair of disk assemblies mounted and secured on a rotatable knurled shaft supported by appropriate bearings, each of said disk assemblies comprising a contoured plastic hub fitted and faced with a metal stamping coated with a single grit diamond abrasive and contoured to match the contour of the outer surface of said hub and shaped nominally on its said outer coated surface as a truncated cone, said assemblies being press-fitted onto said shaft with the smaller end of each disk assembly's abrasive coated metal stamping surface in nominal physical contact with each other so that the knife to be sharpened passes in contact simultaneously with the diamond abrasive surfaces on each assembly at a non-perpendicular angle to said shaft.

22. The sharpening element of claim 21, wherein said sharpening element is the sharpening element in each stage of a three stage sharpener.

23. The sharpening element of claim 22, wherein said sharpener is a manual sharpener.

24. The sharpening element of claim 21, wherein said non-perpendicular angle is from 10 to 15 degrees off axis.

* * * * *